US011466916B2

(12) United States Patent
Bauriedl et al.

(10) Patent No.: US 11,466,916 B2
(45) Date of Patent: Oct. 11, 2022

(54) DEVICE FOR SELECTIVELY PROVIDING CRUSHED OR UNCRUSHED ICE

(71) Applicant: emz-Hanauer GmbH & Co. KGaA, Nabburg (DE)

(72) Inventors: Josef Bauriedl, Neunburg vorm Wald (DE); Albert Dimberger, Neunburg vorm Wald (DE)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 1 day.

(21) Appl. No.: 16/991,093

(22) Filed: Aug. 12, 2020

(65) Prior Publication Data

US 2021/0048235 A1 Feb. 18, 2021

(30) Foreign Application Priority Data

Aug. 13, 2019 (DE) ..... 10 2019 005 688.4

(51) Int. Cl.
*F25C 5/04* (2006.01)
*F25C 5/20* (2018.01)

(52) U.S. Cl.
CPC ..... *F25C 5/046* (2013.01); *F25C 5/22* (2018.01); *F25C 2400/10* (2013.01)

(58) Field of Classification Search
CPC .... F25C 5/046; F25C 5/22; F25C 5/18; F25C 2400/10; F25D 2323/021; F25D 23/04
See application file for complete search history.

(56) References Cited

U.S. PATENT DOCUMENTS 3,824,805 A * 7/1974 Prada ..... F25C 5/02 62/320
5,273,219 A * 12/1993 Beach, Jr. ..... F25C 5/046 222/240
9,677,803 B2 6/2017 Bauriedl et al.
2006/0144976 A1* 7/2006 Lee ..... F25C 5/046 241/63
2006/0202072 A1* 9/2006 Lee ..... F25C 5/24 241/101.2

(Continued)

FOREIGN PATENT DOCUMENTS

DE 19444142 A1 8/1969
DE 2108031 A1 9/1971

(Continued)

*Primary Examiner* — Elizabeth J Martin
(74) *Attorney, Agent, or Firm* — Hayes Soloway PC

(57) ABSTRACT

A device for selectively providing crushed or uncrushed ice includes a storage receptacle for storing uncrushed ice pieces, and a grinder, which is fed with ice pieces from the storage receptacle, for crushing the ice pieces. The grinder is concealed behind an end wall which is arranged on a side of the grinder that is opposite the storage receptacle. A mechanical switching element is associated with the grinder and can be switched between two working positions. In its first working position, ice pieces received from the storage receptacle are necessarily introduced into the operating range of the grinder and in its second working position a bypass passage is freed for ice pieces received from the storage receptacle past the grinder. The device also includes a movable adjusting element in mechanical adjusting connection with the switching element.

12 Claims, 4 Drawing Sheets

(56) References Cited

U.S. PATENT DOCUMENTS

Figure 1:
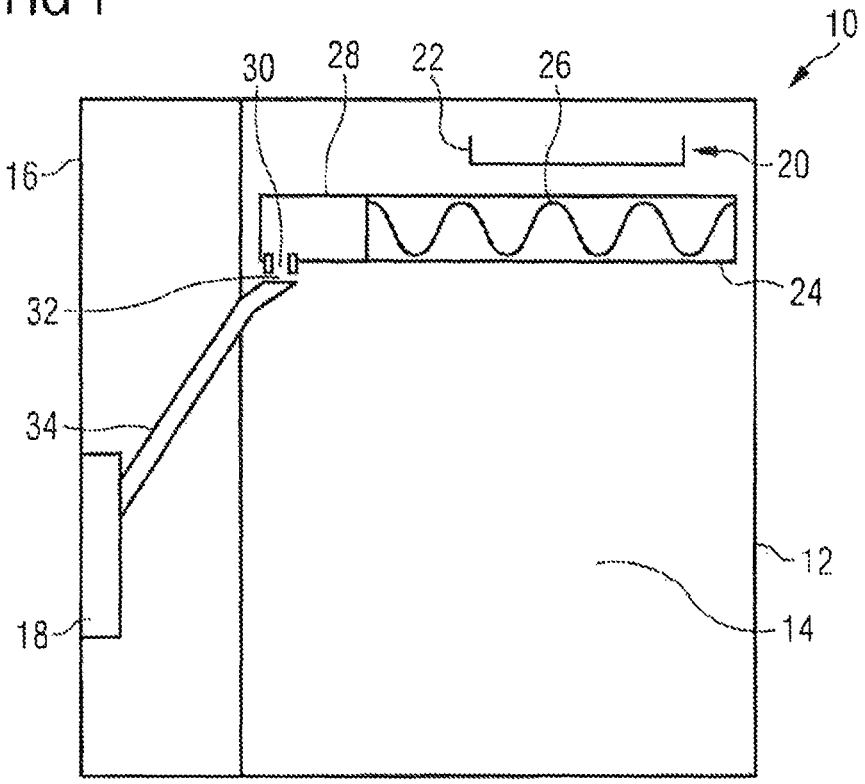

| | | | | |
|---|---|---|---|---|
| 2015/0338147 | A1* | 11/2015 | Bauriedl | F25C 5/22 49/324 |
| 2018/0187942 | A1* | 7/2018 | Hong | F25D 23/04 |
| 2019/0011166 | A1* | 1/2019 | Bertolini | F25C 5/22 |
| 2019/0331385 | A1* | 10/2019 | Jeong | F25C 5/046 |

FOREIGN PATENT DOCUMENTS

| | | | |
|---|---|---|---|
| EP | 1482262 | A1 | 1/2004 |
| EP | 1701118 | B1 | 2/2006 |
| EP | 1707906 | A2 | 4/2006 |
| WO | 2008/077704 | A2 | 3/2008 |

* cited by examiner

DEVICE FOR SELECTIVELY PROVIDING CRUSHED OR UNCRUSHED ICE

The invention relates to a device for selectively providing crushed or uncrushed ice, and to a domestic refrigeration appliance equipped with such a device.

Domestic refrigerators are frequently supplied with an ice maker in the freezer compartment of the refrigerator, by means of which ice maker ice pieces of a defined shape can be produced in an automated manner, that is to say without the assistance of the user. The ice pieces are commonly referred to as ice cubes, even though they do not necessarily have to have a cube shape but are sometimes also created with a different form. In conventional ice makers, the ice cubes are emptied from a tray, in which the ice cubes were previously produced by the freezing of water poured into the tray, into a storage receptacle, in which a larger amount of ice cubes can be collected and stored. Users frequently wish to be able to obtain crushed ice instead of ice cubes, for example because crushed ice is more suitable for some drinks than the comparatively larger, uncrushed ice cubes. Conventional ice makers are therefore equipped with a grinder downstream of the storage receptacle, which grinder offers the desired crushing function and makes possible the delivery of crushed ice. Since users generally do not always wish to enjoy only the same type of ice but at one time would like to receive uncrushed ice cubes and at another time would like to obtain crushed ice cubes, conventional ice makers are equipped with a mechanism which makes it possible to guide ice cubes from the storage receptacle past the grinder, if required, so that these ice cubes are not subjected to the action of the grinder and remain whole. If, on the other hand, the delivery of crushed ice is desired, said mechanism in conventional ice makers ensures that ice cubes from the storage receptacle are necessarily introduced into the operating range of the grinder and are there crushed by the grinder.

For the prior art relating to conventional ice makers having a grinder for providing crushed ice, reference is made, for example, to EP 1 707 906 A2, EP 1 482 262 A1, DE 2 108 031 A, WO 2008/077704 A2 and U.S. Pat. No. 9,677,803 B2.

In conventional ice makers, the storage receptacle is designed with a feed device by means of which the ice cubes in the storage receptacle can be moved in a feed direction to the grinder. For example, this feed device in conventional ice makers comprises a feed shaft wound along a helical line, see DE 2 108 031 A1. When viewed in the feed direction, the grinder in conventional ice breakers is covered on the side opposite the storage receptacle by an end wall, behind which the grinder is concealed. This end wall is conventionally part of a grinder housing in which the grinder is accommodated.

An object of the invention is to provide a structurally simple yet functionally reliable construction for a device, which permits the selective delivery of crushed or uncrushed ice pieces.

In order to achieve this object, such a device comprises according to the invention a storage receptacle for storing uncrushed ice pieces, a grinder, which is fed with ice pieces from the storage receptacle, for crushing the ice pieces, and a movable adjusting element. The grinder is concealed behind an end wall which is arranged on a side of the grinder opposite the storage receptacle and extends at least over the entire width of the storage receptacle. Associated with the grinder is a mechanical switching element which can be switched between two working positions and which in a first of its working positions ensures that ice pieces received from the storage receptacle are necessarily introduced into the operating range of the grinder and in its second working position frees a bypass passage for ice pieces received from the storage receptacle past the grinder. The movable adjusting element is in mechanical adjusting connection with the switching element and is so arranged that it is accessible from the wall side of the end wall that is remote from the grinder or from a side wall adjoining the end wall. The adjusting element thereby engages into a wall opening formed in the wall in question, or the mechanical adjusting connection of the adjusting element with the switching element is established through such a wall opening.

In the solution according to the invention, the end wall or a side wall adjoining the end wall is used as the location for an opening into which the adjusting element can be inserted or through which the adjusting element can extend. The arrangement of the opening at the end wall or side wall ensures that only comparatively short paths between the adjusting element and the switching element have to be bridged in order to mechanically couple the two components with one another. The accessibility of the adjusting element from the side of the end wall or side wall that is remote from the grinder creates freedom in respect of the direction from which an adjusting force is introduced into the adjusting element for the purpose of switching the switching element between the two working positions. For example, the solution according to the invention makes it possible to introduce such an adjusting force into the adjusting element from the side of the end wall or side wall that is remote from the grinder.

In some embodiments, the end wall extends beyond the storage receptacle on both sides, that is to say is wider than the storage receptacle and protrudes beyond it both in a direction to the right and in a direction to the left (from the point of view of an observer standing in front of the refrigeration appliance and looking at the end wall).

In some embodiments, the adjusting element is movable in a plane parallel to the end wall or side wall into two operating positions in accordance with the two working positions of the switching element.

In some embodiments, the wall opening is formed by a wall cutout into which the adjusting element is inserted to be movable between its two operating positions, wherein there are formed at the edge of the wall cutout one or more locking recesses for locking engagement by at least one resiliently arranged locking projection of the adjusting element.

The adjusting element is in the form of, for example, a rotatable adjusting wheel or a translationally movable adjusting slider.

In some embodiments, the adjusting element is movable between two operating positions in accordance with the two working positions of the switching element, wherein the switching element is biased in the direction towards its first working position by biasing means and wherein there are associated with the adjusting element locking structures for locking the adjusting element in each of the two operating positions. Accordingly, in each of the two working positions, the occurrence of forces which cause the switching element to be urged in the direction of the respective other working position is to be expected. In the second working position, the biasing means exert such a force. In the first working position, ice pieces which have been guided by means of the switching element into the grinder may attempt to escape from the grinder to some extent. Such ice pieces may press against the switching element and attempt to push it out of the first working position. The locking structures are advantageously configured in such a manner that they are able to withstand the forces described here.

In some embodiments, the switching element is formed by a lever body which is pivotable about a pivot axis and the pivot axis of which is oriented substantially perpendicularly to the end wall, wherein a first lever arm of the lever body performs the function of the switching element and a second lever arm is in mechanical adjusting connection with the adjusting element. In some embodiments, an elongated hole is formed in the second lever arm, into which hole there engages a pin body which is coupled for movement with the adjusting element, wherein the pin body is movable by means of the adjusting element along a curved path, in particular an arcuate path.

According to a further aspect, the present invention provides a domestic refrigeration appliance, comprising: a cold chamber; an ice-collecting unit; and an insertion compartment, formed in the cold chamber, for the ice-collecting unit, wherein the insertion compartment has an insertion opening. The ice-collecting unit comprises: a storage receptacle for storing uncrushed ice pieces; a grinder for crushing ice pieces from the storage receptacle; a mechanical switching element which can be switched between two working positions and which in a first of the working positions causes ice pieces received from the storage receptacle to be necessarily introduced into the grinder and in a second of the working positions frees a bypass passage for ice pieces received from the storage receptacle past the grinder; a screen, which in an insertion position of the ice-collecting unit, in which the ice-collecting unit is inserted into the insertion compartment, covers the insertion opening completely; and a movable adjusting element in mechanical adjusting connection with the switching element. An opening is formed in the screen, wherein the adjusting element engages into the opening or the mechanical adjusting connection of the adjusting element with the switching element is established through the opening.

In some embodiments, the insertion compartment is delimited by compartment walls which in the insertion position of the ice-collecting unit surround the storage receptacle on all sides at the top, at the bottom and laterally.

In some embodiments, the domestic refrigeration appliance further comprises: a door for closing the cold chamber, wherein there is formed in the door an ice-ejection channel which runs from a channel access arranged on the inside of the door to an ice-dispensing compartment which is accessible from outside the door. When the door is closed, an ice outlet of the ice-collecting unit is arranged in a position opposite the channel access in order, according to the working position of the switching element, to transfer uncrushed or crushed ice pieces from the ice outlet into the ice-ejection channel.

Figure 2:
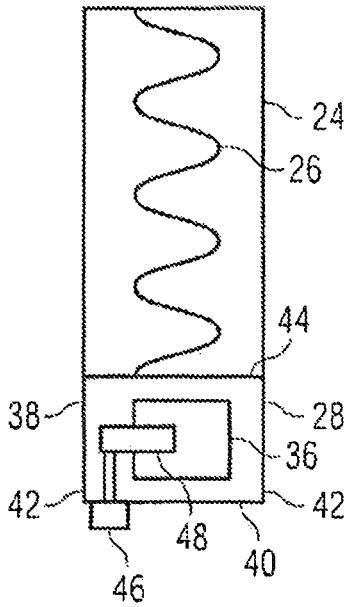
Figure 3:
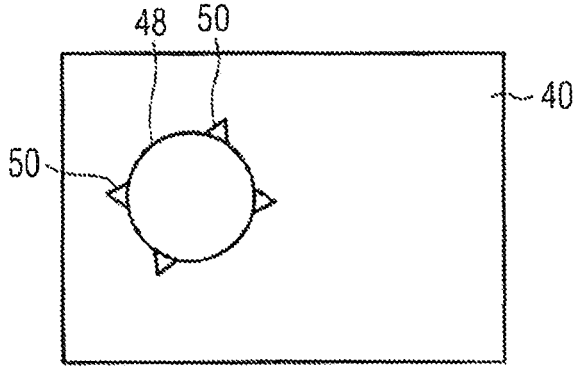
Figure 4:
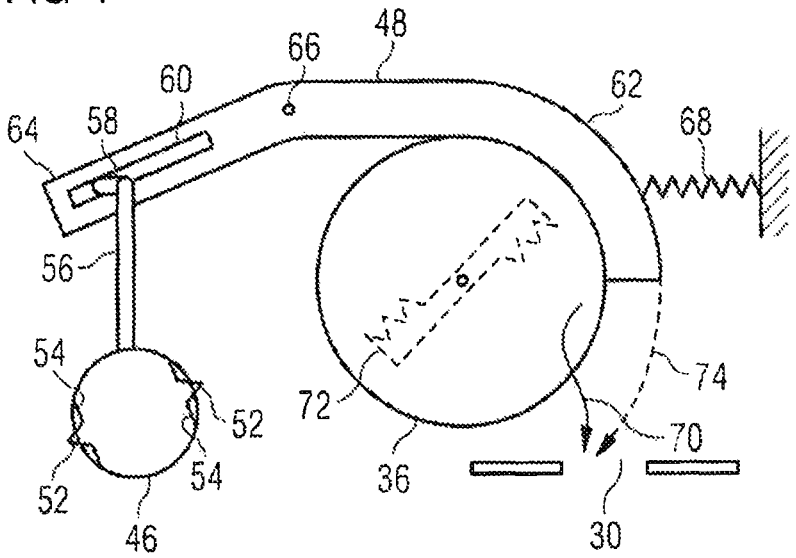
Figure 5:
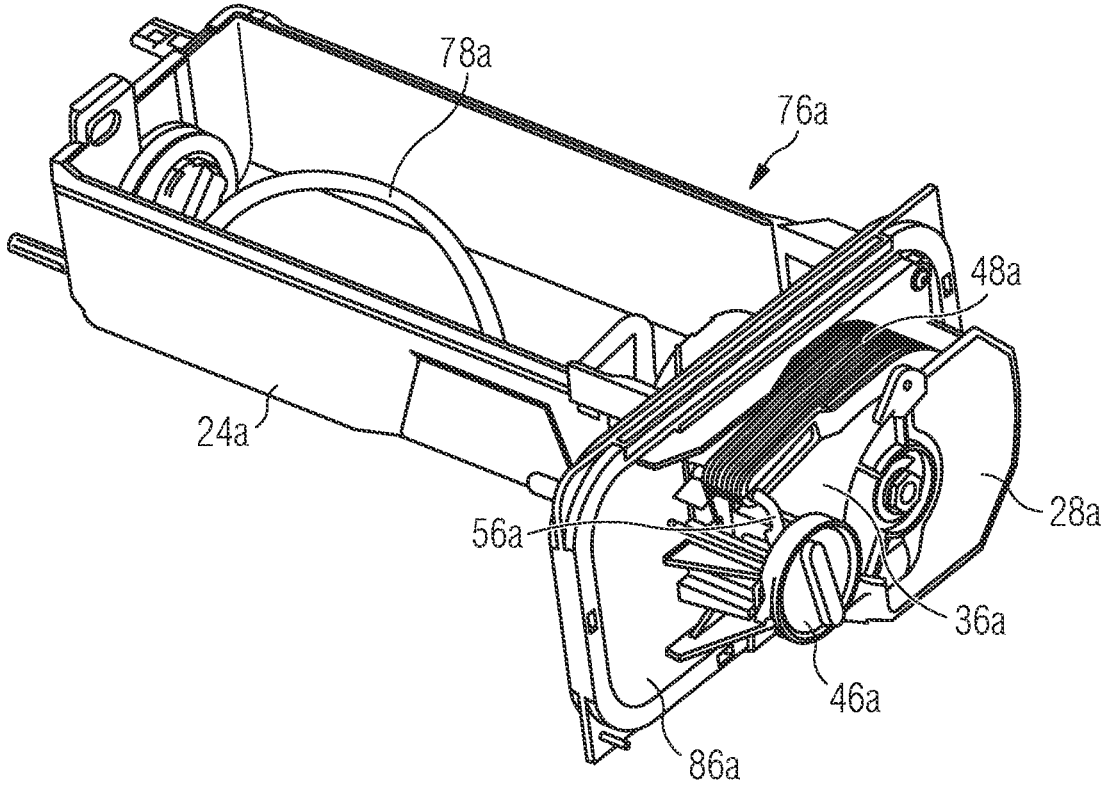
Figure 6:
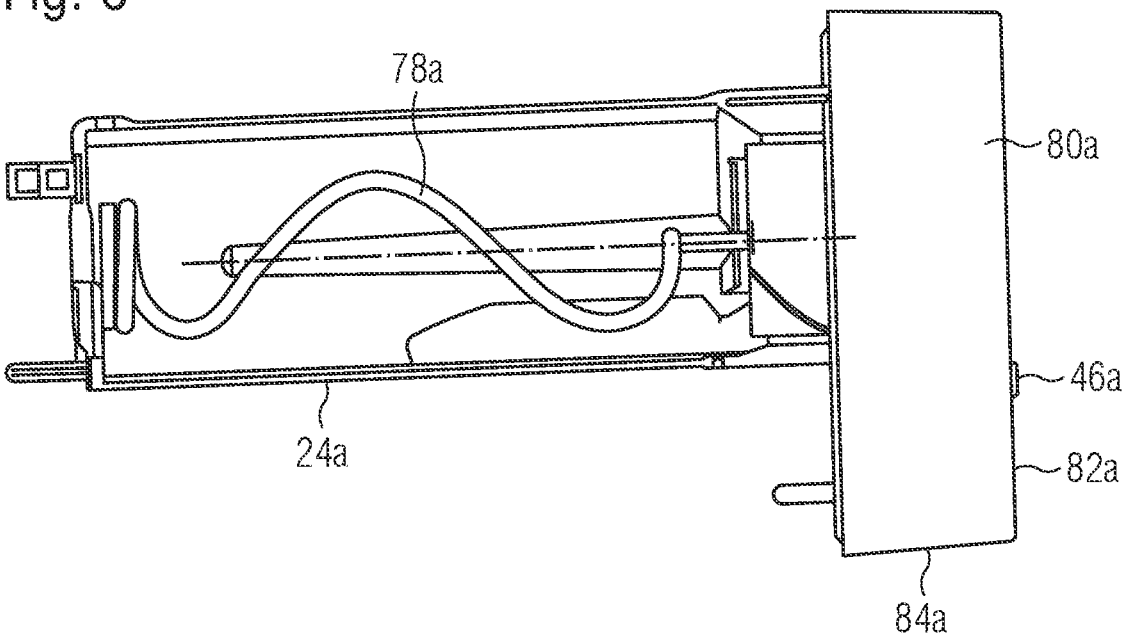
Figure 7:
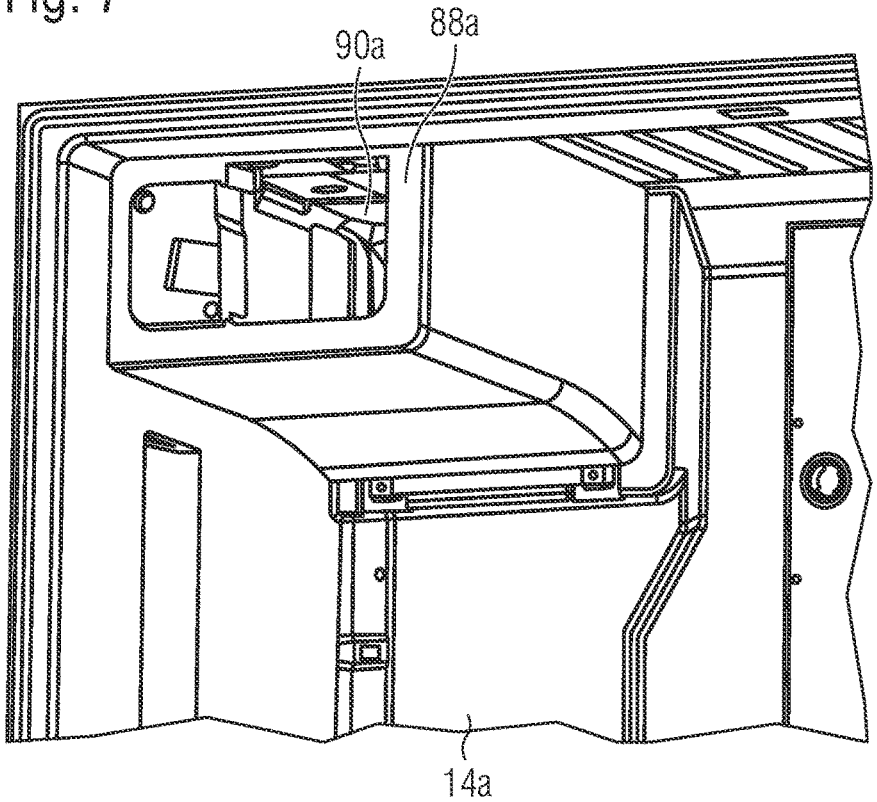
Figure 8:
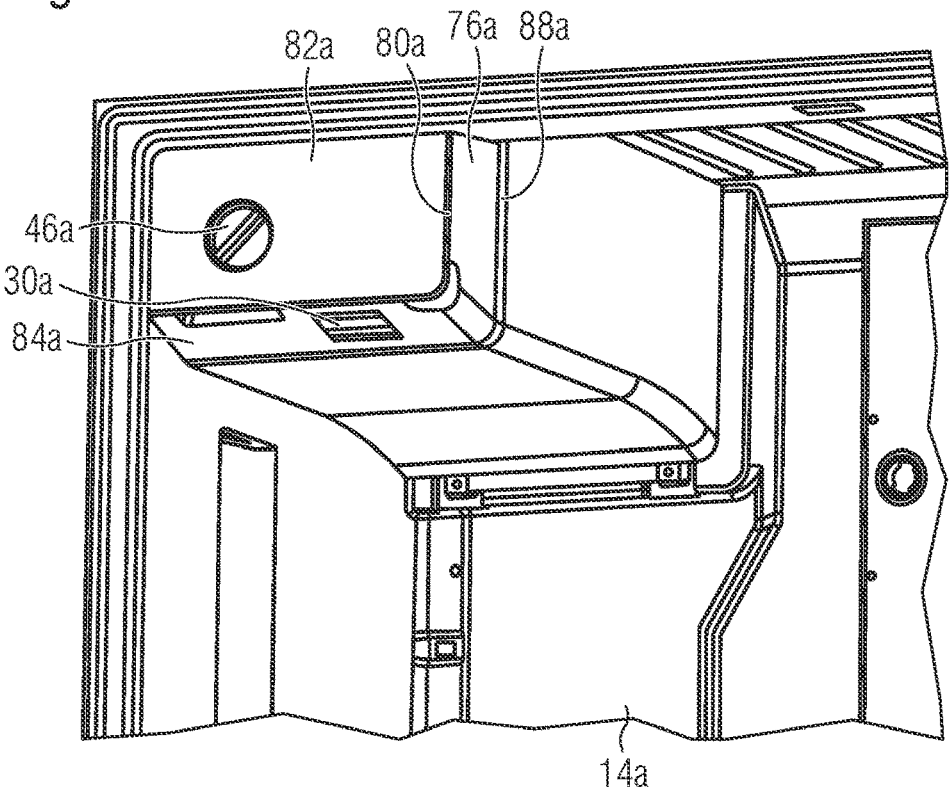

The invention will be described in greater detail hereinbelow with reference to the accompanying drawings, in which:

FIG. 1 shows, schematically, a domestic refrigerator with an ice maker according to an exemplary embodiment fitted in a freezer compartment thereof, FIG. 2 is a schematic view from above of a storage receptacle and a crushing unit of the ice maker of FIG. 1, FIG. 3 is a front view of an end housing wall of the crushing unit of FIG. 2, FIG. 4 shows, schematically, components of the crushing unit of FIG. 2 in order to explain the functioning thereof, FIG. 5 is a perspective view of an ice-collecting unit according to an exemplary embodiment, wherein the ice-collecting unit is shown without a front screen, FIG. 6 is a plan view of the ice-collecting unit of FIG. 5 with the screen present, FIG. 7 shows, in perspective, a detail of a cold chamber of a domestic refrigeration appliance according to an exemplary embodiment, wherein an insertion compartment for the ice-collecting unit of FIGS. 5 and 6 is formed in the cold chamber, and FIG. 8 shows the cold chamber of FIG. 7, wherein the ice-collecting unit of FIGS. 5 and 6 has been inserted into the insertion compartment.

Reference will first be made to FIG. 1. The domestic refrigerator shown schematically therein is designated generally 10; it comprises a refrigerator body 12 in which there is delimited an internal space (cold chamber) 14 which serves to keep foods cold, and a door 16 which is mounted on the refrigerator body 12 in a manner known per se to be pivotable about a vertical pivot axis. On the outside of the door there is formed an ice-dispensing compartment 18, into which a user can place a vessel in order to be able to obtain ice cubes or crushed ice produced by means of an ice maker 20 of the refrigerator 10. The ice maker 20 is accommodated in a freezer region of the internal space 14 and comprises in a manner known per se an ice-making tray 22, which can be filled with fresh water from a water supply, not shown. As soon as the water in the ice-making tray 22 has frozen to form ice cubes, the ice cubes are emptied into a storage receptacle 24 which is located beneath the ice-making tray 22 and in which the ice cubes produced are collected and stored for later use by the user. Different types of ice-cube production are generally known to the person skilled in the art and a limitation of the type of production of the ice cubes provided in the storage receptacle 24 is not intended here. The storage receptacle 24 is equipped with a feed device 26, for example in the form of a motor-driven shaft which is wound along a helix line. The feed device 26 makes it possible to feed ice pieces in the storage receptacle 24 in the direction towards a crushing unit 28, which makes it possible to crush the ice pieces. The crushing unit 28 can be switched between a first working mode, in which it crushes ice pieces supplied to it from the storage receptacle 24, and a second working mode, in which it leaves such ice pieces whole. Accordingly, depending on the working mode that is set, either crushed ice is delivered at an ice outlet 30 of the crushing unit 28 or whole ice cubes are delivered there.

When the door 16 is closed, the ice outlet 30 of the crushing unit 28 is located in a position opposite a channel access 32 which is arranged on the door side and from which an ice-ejection channel 34 formed in the door 16 extends to the ice-dispensing compartment 18. When the door 16 is closed, ice (crushed or uncrushed) delivered by the crushing unit 28 passes through the ice-ejection channel 34 to the ice-dispensing compartment 18. When the door 16 is open, a shut-off flap (not shown) provided at the ice outlet 30 can prevent ice from unintentionally leaving the crushing unit 28.

Reference will now additionally be made to FIG. 2. The crushing unit 28 contains a grinder 36, indicated schematically, which is received in a grinder housing 38. The grinder 36 comprises, for example and in a manner known per se, a plurality of grinding arms which are driven in rotation and by means of which ice pieces, when they are transferred from the storage chamber 24 into the crushing unit 28 and when the crushing unit 28 is set in its crushing working mode (i.e. first working mode), are caught and crushed in cooperation with stationary, that is to say non-rotating, grinding counter-surfaces. The grinder housing 38 comprises an end wall 40, which is situated on the side of the grinder 36 that is remote from the storage receptacle 24, and also side walls 42, which adjoin the end wall 40, as well as a rear wall 44, which delimits the grinding unit 28 with respect to the storage receptacle 24. In the example shown, an adjusting element 46 is arranged on the end wall 40, which adjusting element is in mechanical adjusting connection with a switching element 48 by means of which the crushing unit 28 can be switched between the mentioned crushing working mode, in which ice pieces are crushed in the crushing unit 28, and a bypass working mode (second working mode), in which the switching element 48 frees a bypass passage for ice pieces past the grinder 36. In the bypass working mode, ice pieces which enter the crushing unit 28 from the storage receptacle 24 accordingly remain out of reach of the grinder 36 and can pass whole to the ice outlet 30 of the crushing unit 28. Alternatively, the adjusting element 46 could be arranged on one of the side walls 42. The adjusting element 46 is accessible from the outer side of the end wall 40 that is remote from the grinder, that is to say an adjusting force can be introduced into the adjusting element 46 from the wall outer side of the end wall 40.

Reference will now additionally be made to FIGS. 3 and 4. According to FIG. 3, an opening in the form of a circular wall cutout 48 is formed in the end wall 40 in one exemplary embodiment, which opening passes through the entire thickness of the end wall 40. At the edge of the wall cutout 48 there are formed multiple (here four) locking recesses 50, which serve to lock the adjusting element 46 in position. As can be seen in FIG. 4, the adjusting element 46 has a generally circular outline, wherein the adjusting element 46 carries at least one and in the example shown two locking projections 52 arranged opposite one another, which are suitable for engaging into a pair of opposing locking recesses 50. The locking projections 52 are each formed on a resilient bridge 54, by means of which a radial (radial with respect to the circular form of the adjusting element 46) deflectability of the locking projections 52 is made possible. The adjusting element 46 can be inserted into the wall cutout 48 (so that it is recessed in the end wall 40) and is rotatable in the wall cutout between two operating positions, each of which is defined by the engagement of the locking projections 52 into a respective different pair of locking recesses 50.

According to FIG. 4, the adjusting element 46, which can also be referred to as an adjusting wheel in the example shown, is designed with a coupling yoke 56 which engages with an angled, pin-like end piece 58 in a linear elongated hole 60 of the switching element 48. The coupling yoke 56 is or can be rotatably connected to the adjusting element 46, so that, on rotation of the adjusting element 46, the coupling yoke 56 rotates with it. The end piece 58 thereby describes an arcuate path, which is accompanied by a displacement of the position of the end piece 58 in the elongated hole 60 and consequently tilting of the switching element 48.

In the example shown, the switching element 48 is designed as a lever body with two lever arms 62, 64 and is pivotably mounted about a pivot axis 66. The lever arm 62 performs the actual switching function of the switching element 48, the lever arm 64 serves to control the position of the switching element 48. The switching element 48 is biased by a spring element 68 into a lever position which corresponds to the crushing working mode of the crushing unit 28. In this lever position, ice pieces which are transferred from the storage receptacle 24 into the crushing unit 28 are necessarily urged by the lever arm 62 into the operating range of the grinder 36 and accordingly are necessarily crushed. The path of travel of the ice pieces in this first lever position of the switching element 48 is indicated schematically in FIG. 4 by an arrow 70. The operating range of the grinder 36 is determined in the radial direction by the reach of the rotating grinding arms of the grinder 36, wherein in FIG. 4, for the purposes of the illustration, two such grinding arms (offset at an angle of 180 degrees) are indicated at 72 by dotted lines.

By rotation of the adjusting element 46, the switching element 48 can be pivoted from the first lever position into a second lever position (counter-clockwise in the representation of FIG. 4). This second lever position corresponds to the described bypass working mode of the crushing unit 28. The switching element 48 thereby permits a path of travel of the ice pieces past the grinder 36, that is to say the ice pieces reach the ice outlet 30 while bypassing the grinder 36. This path of travel of the ice pieces is indicated in FIG. 4 at 74 by a broken line.

In the first lever position, the locking projections 52 of the adjusting element 46 are in locking engagement with a first pair of the locking recesses 50, and in the second lever position, the locking projections 52 are in locking engagement with a different pair of the locking recesses 50. In both lever positions, the locking engagement is sufficiently powerful to hold the switching element 48 in the respective lever position. For the first lever position, this means that the locking engagement must be able to withstand forces which may be exerted on the switching element 48 by ice cubes which are being crushed in the grinder 36. For the second lever position, this means that the locking engagement must be able to withstand the biasing force of the spring element 68.

In a modified embodiment, the wall opening is in the form of an elongated slot through which an adjusting element which is connected to the switching element 48 and is in the form of, for example, a pivot lever is guided to the outer side of the wall in which the opening is formed. This wall is, for example, one of the side walls 42. The adjusting element can be moved to and fro in the slot in the slot longitudinal direction, in accordance with the two lever positions of the switching element 48.

Reference will now be made to the exemplary embodiment according to FIGS. 5 to 8. As far as components which are the same or have the same action are concerned, the same reference numerals as in FIGS. 1 to 4 are used to identify such components, but with the addition of a lowercase letter. Unless indicated otherwise hereinbelow, reference is made to the above observations relating to FIGS. 1 to 4 for the explanation of such components which are the same or have the same action.

The ice-collecting unit of FIGS. 5 and 6 is designated generally **76*a*. It comprises an elongate storage receptacle 24*a*, configured in the manner of a trough, for storing ice pieces, and a crushing unit 28*a* for crushing ice pieces as required, which ice pieces can be conveyed from the storage receptacle 24*a* by means of a conveyor screw 78*a* serving as a feed device in the direction towards a front trough end of the storage receptacle 24*a*, where they enter the region of the crushing unit 28*a* and a grinder 36*a* contained therein. The crushing unit 28*a* corresponds, for example, to the crushing unit 28 of the exemplary embodiment of FIGS. 1 to 4. The ice-collecting unit 76*a* comprises a screen 80*a* with a front end wall 82*a* and a collar 84*a* protruding in the backwards direction from the end wall 82*a*. The screen 80*a* is slipped over the crushing unit 28*a* from the front, so that the grinder 36*a* is concealed behind the end wall 82*a*. The collar 84*a* rests with its collar edge remote from the end wall 82*a* on an intermediate plate 86*a*, which is arranged at the transition from the storage receptacle 24***a* to the crushing unit 28*a* and, together with the screen 80*a*, forms a grinder housing for the grinder 36*a*. In FIG. 6, it can be seen that the end wall 82*a* extends over the entire trough width of the storage receptacle 24*a* and protrudes beyond the storage receptacle 24*a* on both sides (that is to say both to the right and to the left from the point of view of an observer looking at the ice-collecting unit 76*a* in the installed situation thereof in a domestic refrigeration appliance).

The ice-collecting unit 76*a* is provided to be inserted as a whole into an insertion compartment 88*a* (FIG. 7), which is formed in a cold chamber 14*a* of a domestic refrigerator or of a domestic freezer or of a fridge/freezer combination and has an insertion opening 90*a* for the ice-collecting unit 76*a*. FIG. 7 shows the situation when the insertion compartment 88*a* is unoccupied, while FIG. 8 shows the occupied state of the insertion compartment 88*a* when the ice-collecting unit 76*a* has been inserted into the compartment. In the inserted state, the screen 80*a* of the ice-collecting unit 76*a* covers the insertion opening 90*a* completely. An adjusting element 46*a*, which corresponds, for example, to the adjusting element 46 of FIGS. 2 to 4 and in the exemplary embodiment of FIGS. 5 to 8 is inserted into a circular cutout of the end wall 82*a* (that is to say into a wall opening) and is held therein, is easily accessible to a user standing in front of the cold chamber 14*a*, more precisely to the finger of a hand of the user, so that the user, by operating the adjusting element 46*a*, can manually switch the crushing unit 28*a* between the delivery of uncrushed ice pieces and the delivery of crushed ice pieces. Alternatively, it is conceivable to provide an adjusting element having such a function on the collar 84*a* of the screen 80*a*.

The insertion compartment 88*a* forms a housing which surrounds the storage receptacle 24*a*—when the ice-collecting unit 76*a* has been inserted into the insertion compartment 88*a*—laterally, at the top and at the bottom, that is to say on all sides. The temperatures prevailing in the insertion compartment 88*a* permit the freezing of water. Freezing temperatures may likewise prevail in the regions of the cold chamber 14*a* that are outside the insertion compartment 88*a*, or temperatures can be present therein which allow foods to be kept cold without freezing.

The invention claimed is:

1. A domestic refrigeration appliance comprising:

a cold chamber;

an ice-collecting unit; and an insertion compartment, formed in the cold chamber, for the ice-collecting unit, wherein the insertion compartment has an insertion opening, wherein the ice-collecting unit comprises:

a storage receptacle for storing uncrushed ice pieces;

a grinder for crushing ice pieces from the storage receptacle;

a mechanical switching element switchable between a position in which ice pieces received from the storage receptacle are necessarily introduced into the grinder and a position in which a bypass passage is freed for ice pieces received from the storage receptacle past the grinder;

a screen, which in an insertion position of the ice-collecting unit, in which the ice-collecting unit is inserted into the insertion compartment, covers the insertion opening completely and conceals an ice-making device positioned in the cold chamber to supply uncrushed ice pieces to the storage receptacle of the ice-collecting unit from a user's view into the cold chamber; and a movable adjusting element in mechanical adjusting connection with the switching element, wherein an opening is formed in the screen, and wherein the adjusting element extends at least partially through the opening to connect the adjusting element with the switching element through the opening whereby the mechanical adjusting connection of the adjusting element with the switching element is established through the opening.

2. The domestic refrigeration appliance according to claim 1, wherein the insertion compartment is delimited by compartment walls which in the insertion position of the ice-collecting unit surround the storage receptacle on all sides at the top, at the bottom and laterally.

3. The domestic refrigeration appliance according to claim 1, further comprising:

a door for closing the cold chamber, wherein there is formed in the door an ice-ejection channel which runs from a channel access arranged on the inside of the door to an ice-dispensing compartment which is accessible from outside the door, wherein, when the door is closed, an ice outlet of the ice-collecting unit is arranged in a position opposite the channel access in order, according to the position of the switching element, to transfer uncrushed or crushed ice pieces from the ice outlet into the ice-ejection channel.

4. A device for selectively providing crushed or uncrushed ice comprising:

a storage receptacle for storing uncrushed ice pieces;

a grinder, which is fed with ice pieces from the storage receptacle, for crushing the ice pieces, wherein the grinder is concealed behind an end wall which is arranged on a side of the grinder opposite the storage receptacle and extends at least over the entire width of the storage receptacle;

a mechanical switching element which is associated with the grinder and switchable between a position in which ice pieces received from the storage receptacle are necessarily introduced into the operating range of the grinder and a position in which a bypass passage is freed for ice pieces received from the storage receptacle past the grinder; and a movable adjusting element in mechanical adjusting connection with the switching element, wherein the adjusting element is accessible from the wall side of the end wall that is remote from the grinder or from a side wall adjoining the end wall, wherein a wall opening is formed in the end wall or side wall and the adjusting element extends at least partially through the wall opening to connect the adjusting element with the switching element through the wall opening whereby the mechanical adjusting connection of the adjusting element with the switching element is established through the wall opening.

5. The device according to claim 4, wherein the adjusting element is movable in a plane parallel to the end wall or side wall into two operating positions.

6. The device according to claim 5, wherein the wall opening is formed by a wall cutout into which the adjusting element is inserted to be movable between its two operating positions, wherein there are formed at the edge of the wall cutout one or more locking recesses for locking engagement by at least one locking projection of the adjusting element.

7. The device according to claim 4, wherein the adjusting element is in the form of a rotatable adjusting wheel.

8. The device according to claim 4, wherein the adjusting element is movable between two operating positions, and wherein the switching element is biased by biasing means and wherein there are associated with the switching element locking structures for locking the adjusting element in each of the two operating positions.

9. The device according to claim 4, wherein the switching element is formed by a lever body which is pivotable about a pivot axis and the pivot axis of which is oriented substantially perpendicularly to the end wall, wherein a first lever arm of the lever body performs the function of the switching element and a second lever arm is in mechanical adjusting connection with the adjusting element.

10. The device according to claim 9, wherein an elongated hole is formed in the second lever arm, into which hole there engages a pin body which is coupled for movement with the adjusting element, wherein the pin body is movable by means of the adjusting element along a curved path.

11. The device according to claim 9, wherein an elongated hole is formed in the second lever arm, into which hole there engages a pin body which is coupled for movement with the adjusting element, wherein the pin body is movable by means of the adjusting element along an arcuate path.

12. The device of claim 4, wherein the movable adjusting element is adapted to be moved manually by a user.

* * * * *